US006510635B1

(12) United States Patent
Rudolph et al.

(10) Patent No.: US 6,510,635 B1
(45) Date of Patent: Jan. 28, 2003

(54) MODULAR FRAME SYSTEM

(75) Inventors: Susan C. Rudolph, San Diego, CA (US); Carol K. Honeysett, San Diego, CA (US)

(73) Assignee: Sign Matrix, Inc., San Diego, CA (US)

( * ) Notice: Subject to any disclaimer, the term of this patent is extended or adjusted under 35 U.S.C. 154(b) by 0 days.

(21) Appl. No.: 09/663,647

(22) Filed: Sep. 18, 2000

(51) Int. Cl.[7] ..... G09F 1/12

(52) U.S. Cl. ..... 40/658; 40/606; 248/489; 52/489.1; 52/506.08

(58) Field of Search ..... 40/606, 658; 248/476, 248/495, 489; 52/483.1, 489.1, 489.2, 506.06, 506.08; 211/94.01

(56) References Cited

U.S. PATENT DOCUMENTS 2,947,093 A * 8/1960 Masters ..... 52/36.5
2,994,148 A * 8/1961 Endelson ..... 40/546
4,459,773 A * 7/1984 Sandlin et al. ..... 40/603
4,697,365 A * 10/1987 Moosbrugger et al. ..... 40/546
5,295,651 A * 3/1994 Baker, Jr. ..... 248/488

* cited by examiner

*Primary Examiner*—Cassandra H. Davis
(74) *Attorney, Agent, or Firm*—Donn K. Harms

(57) ABSTRACT

A frame system for displaying panels such as signs, artwork, photographs, text etc., on a surface such as a wall. Two long tracks have fasteners for fastening them to a surface. Two corresponding cover bars are shaped to slide longitudinally over the tracks while being retained on the tracks. The cover bars have lengthwise grooves for supporting edges of one or more panels between opposite cover bars while allowing the panels to slide along the grooves. Caps are fastened over the ends of the cover bars with removable, tamper resistant, fasteners to prevent the cover bars from being slid out of the tracks until the caps are removed. The system may be mounted on a surface with the tracks horizontal, vertical or any angle in between. While the tracks will ordinarily be mounted parallel to each other, they may be mounted at angles to each other to accommodate panels of shapes other than rectangular.

17 Claims, 1 Drawing Sheet

MODULAR FRAME SYSTEM

FIELD OF THE INVENTION

This invention relates to frames for pictures, signs and the like for wall.

BACKGROUND OF THE INVENTION

A variety of different frames have been developed for mounting paintings, signs, photographs, printed documents, directories, etc., on walls and other surfaces. Conventionally, frames have four sides with an open central area for receiving the material to be displayed. The front surface of the frame typically is decorative, shaped and/or painted in an attractive manner. The frame is solid, generally a pre-determined size, with a backing, with a center recessed area or open area to receive the material to be displayed. A transparent sheet, such as glass, may be placed in the recess over the displayed material for protection. The cover sheet and material on display are typically held in place by fasteners such as adhesive, brads, or glazier's points. The frame displaying a picture, photo, etc. is conventionally hung on a wall by means of a nail in the wall over which a wire or bracket on the back of the frame is placed. A frame displaying a sign, printed material, etc., is conventionally hung on a wall by means of adhesive and/or exposed or concealed mechanical attachment(s). Therefore conventional frames holding artwork, photos, or signs are rarely transparent, as one would see the means for attachment. While this is necessary, it is limiting as to the items one can display in the frame (i.e., no clear items, no translucent items).

While suitable for many purposes, these frames have a number of limitations. Typically, only one standard size of material to be displayed fits into any given frame at any given time. This standard size/shape is usually a square or rectangular shape of a certain depth. This limits the displaying of shapes other than rectangles or squares such as irregular, odd shaped or free formed items. In addition, displaying multiple layers of items is limited, as well as curved (concave and or convex items). Also, the display of items of differing thicknesses is not feasible.

Removal of the item being displayed and replacement with a new item is difficult at best and often results in the damage of the item being displayed, the frame or of the wall to which the frame is attached. It is difficult, time consuming and often one damages a conventional frame or the surface that it is mounted to should one choose to remove the existing insert (picture, etc) and change the displayed material. Also with conventional frames the displayed material is easy for vandals to have access to the contents without any means to prevent this. In other words the frame and its contents are not protected against tampering or removal. Conventional frames allow tampering and vandalism, since persons passing by can easily reach and steal or damage the picture, sign, etc. being displayed. Such tampering can include scratching or peeling material from a displayed sign to theft of the entire item being displayed.

Attempts have been made to developing frame systems having greater variability, to accommodate different sizes and thicknesses of displayed material. These, such as side, top and bottom pieces that can be combined to provide frames of different heights and widths, will accommodate varying sizes of material. However, they do not overcome problems with security, hanging the frame, etc., as described above.

A complex cornice assembly is described by Sturkie et al. in U.S. Pat. No. 5,511,332. This frame is intended for in-store product display. Horizontal channels are provided into which a display card can be slid and easily replaced when desired. However, this arrangement only accepts a single card of specified thickness and shape. The frame can only be used effectively in a horizontal position. The material displayed is not protected against removal or tampering.

Reim describes a complex frame for pictures in U.S. Pat. No. 4,078,326. A stack is formed of a transparent plate, the picture, a resilient foamed layer and a rigid support plate. Four frame edge parts have channels that are pushed over the edges of the stack and interlock with the stack. Notches are provided in the back of the frame parts so that the frame can be hung over a nail in a wall. This frame can only accept a picture of specific dimensions for which the frame and stack components are selected. The frame can easily be removed from the wall and is subjecting to tilting in use.

Conventional frames allow tampering and vandalism, since persons passing by can easily reach and damage the picture, sign etc. being displayed. Such tampering can include scratching or pealing material from a displayed sign to theft of art work.

Thus, there is a continuing need for improved frame systems that are tamper resistant and held securely to a wall or other panel. There is a need for a frame that can hold objects of different materials, thicknesses, shapes and dimensions, one that is readily expandable to accept longer and larger materials to be displayed, does not require a backpanel, can accept several overlying panels, some of which can be transparent or translucent, can be used at any angle (vertical, horizontal, or any angle in between), and has a sturdy, concealed wall attachment arrangement.

SUMMARY OF THE INVENTION

The above-noted problems, and others, are overcome in accordance with the frame system of this invention, which is basically comprised of a track, a pair of tracks, or as many tracks as the user deems necessary to display an item. The tracks are then secured to a structure, such as a wall. The tracks form a spaced relationship. The coverbars will then slide over the tracks thus concealing the wall attachment means. The coverbars include longitudinal grooves into which panels, signs, photos, etc., can be inserted. The item being displayed will bridge the gap between all tracks and coverbars being used. Caps cover the ends of the tracks and coverbars and are fastened to the tracks with tamper resistant fasteners, thus preventing movement of the coverbars or panels. The caps are removable to allow for the removal of and insertion of new panels, inserts, signs, artwork, etc.

Each track and cover bar assembly can be fastened to any suitable structure, such as a wall, column, display assembly or the like in any desired orientation or quantity. While these assemblies will generally be either horizontal or vertical, other orientations can be used, such as angled to receive a trapezoidal panel, an odd shaped panel, a free-form panel. When accepting a free form shaped panel, the track and coverbars can be mounted in any quantity at any angle with no uniformity at all. The track and cover bar can be assembled in a "v" shaped orientation to receive a "v" shaped panel, etc. Where the assemblies are mounted in a "V" orientation, the panels will have corresponding shapes and will be inserted into the wide end of the "V". Multiple assemblies may be used, such as a continuous linear array to support very long panels or in parallel arrays to support vertically or horizontal adjacent panels. Pairs of track and cover bar assemblies may be mounted next to a wall corner so that the panels carrying the item being displayed wrap around the corner.

The tracks and cover bars may be formed from any suitable material. Aluminum is preferred due to the ease of fabrication by extrusion methods, lightweight, durability, and the ability of aluminum to be anodized in a wide variety of colors. Aluminum also lends itself to being primed and painted or powder coated. Plastic, brass, copper or other materials may be used, if desired. High strength injection molded plastics provide excellent components.

Any suitable panels, of any desired size and shape may be used with this frame system. The integral groove in the cover bar may be sized to hold a single panel, two panels, or any desired multiplicity of panels. The corresponding display panels may be opaque, translucent, or transparent as desired. Any desired coatings, lettering, designs, etc. may be applied to the panels. When displaying a photograph, sign, etc., a transparent cover panel may be used to cover the item being displayed thus preventing vandalism. Removal of the item being displayed is difficult for any unauthorized person, since the fastener used to fasten the assembly is very specific and special, requiring a specialized tool. Removal of the track and cover bar from the wall is difficult since the mounting is hidden and not accessible without disassembling the assembly with specific special tools.

BRIEF DESCRIPTION OF THE DRAWING

Details of the invention, and of preferred embodiments of the invention, will be further understood upon reference to the drawing, wherein.

DETAILED DESCRIPTION OF PREFERRED EMBODIMENTS

Figure 1:
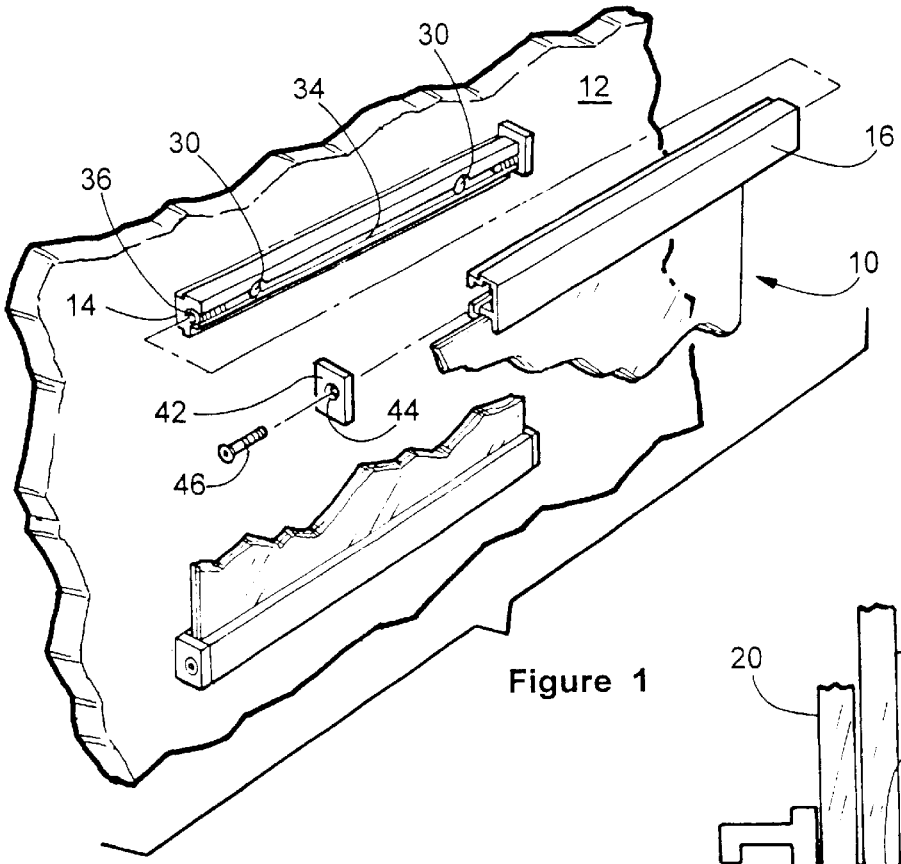
FIG. 1 is a partly exploded perspective view of the frame system of this invention.

Referring to FIG. 1, there is seen the frame system 10 mounted on a support surface 12. In the preferred embodiment shown, two support assemblies each comprising a track 14 and a cover bar 16 slidable over the track. In the embodiment shown, the two tracks 14 are in a horizontal parallel arrangement. As mentioned above, they could be vertical on at an angle to horizontal, or may be other than parallel.

Figure 2:
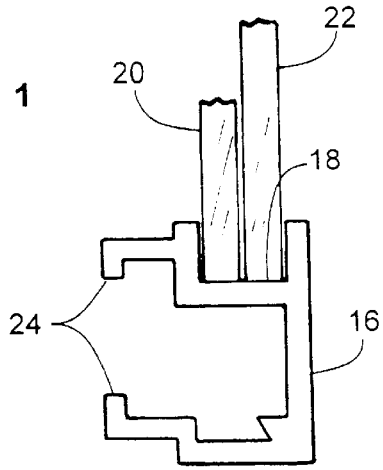
FIG. 2 is a detail end elevation view of a cover bar and panel assembly.

As best seen in FIG. 2, each cover bar 16 has a longitudinal groove 18 for receiving edges of panels, here inner panel 20 and outer panel 22. Any suitable number of panels may be used, with groove 18 sized accordingly. The outer and lower surfaces of cover bar 16 may have any suitable surface configuration and finish. A brushed aluminum surface is particularly attractive.

Typically, single panels 22 may be formed from any suitable material and may bear any suitable indicia. Multiple transparent or translucent panels, with different indica on different panels will provide a desirable depth effect.

Figure 3:
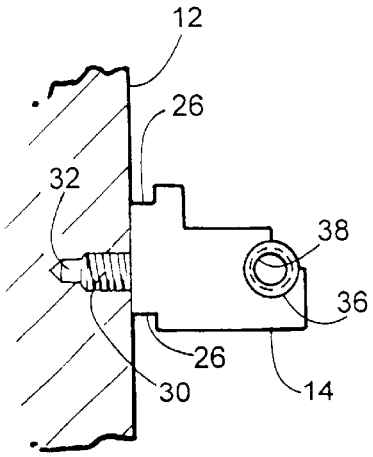
FIG. 3 is a detail section view showing the mounting of a track on a support surface.
Figure 4:
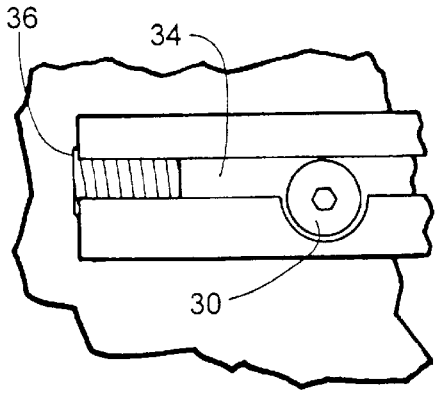
FIG. 4 is a detail view showing an end of a track with the support mount.

A pair of opposed inwardly extending longitudinal edges 24 are provided to fit within longitudinal recesses 26 along track 14 (as seen in FIG. 3) for sliding there along. A plurality of screws 30 or the like pass through corresponding holes (not seen) in track and into holes 32 the wall or other support. Any suitable fasteners may be used, depending upon the construction of wall 12. Where the wall is metal, machine screws extending into threaded holes, or self-threading screws are particularly effective. With plaster or wall board walls, Mollie fasteners or various conventional expanding fasteners may be preferred.

A longitudinal slot 34 is provided along each track 14. A threaded insert 36 having a threaded interior surface 38 is threaded into the ends of each slot 34. While threaded insert 36 could have a smooth exterior and be pressed into the hole and adhesively bonded therein, for best results a threaded insert 36 having a self-threading exterior thread of the sort commercially available under the EZ Lok designation is preferred for ease of use and excellent retention.

A cap 42 having a shape corresponding to the end exterior shape of cover bar 16 has a central countersunk hole 44 corresponding to hole 38 in threaded insert 36. A machine screw 46 or the like is threaded through hole 44 into hole 38. Thus, each end of each cover bar 16 is covered and securely held in place. For best results, screws 46 are configured to be rotated by a tamper resistant tool, such as an Allen wrench, to make tampering with the frame more difficult.

Thus, the frame of this invention is particularly secure, easy to install and modify and attractive. While there are many purposes that this frame system would accomplish, it is ideal for signage near entrance doors identifying businesses, partnerships and the like.

Other applications, ramifications and advantages of this invention will occur to those skilled in the art upon reading this application. Those are intended to be included within the scope of this invention, as defined in the appended claims.

We claim:

1. A frame system which comprises:

at least two elongated tracks;

mounting means for mounting said elongated tracks on a support surface;

at least two elongated cover bars;

cooperating means on said tracks and cover bars for permitting said elongated cover bars to slide along said tracks while retaining said cover bars in contact with said tracks;

groove means along each of said elongated cover bars for retaining a panel edge therein;

cap means for covering ends of said elongated cover bars; and fastening means for releasably fastening said caps to said ends to prevent relative movement between said elongated tracks and said elongated cover bars.

2. The frame system according to claim 1 wherein said mounting means comprises at least two threaded fasteners for extending through transverse holes in said tracks and into threaded holes in said surface.

3. The frame system according to claim 1 wherein said cooperating means comprises longitudinal recesses along said tracks and corresponding longitudinal edges along said cover bars for sliding in said recesses.

4. The frame system according to claim 3 wherein said recesses are located adjacent to said surface when said cover bar is mounted on said surface so that said cover bars substantially entirely cover said tracks.

5. The frame system according to claim 1 wherein said grooves have widths sufficient to retain edges of at least two contiguous panels.

6. The frame system according to claim 1 wherein said means for releasably fastening said caps to said ends comprises threaded members extending through holes in said caps and threaded into threaded openings in said track ends.

7. The frame system according to claim 6 wherein said threaded openings comprise a threaded insert having a threaded exterior threaded into a hole in said track and a threaded interior for receiving said threaded member.

8. The frame system according to claim 1 wherein each said fastening means comprises a countersunk hole through said cap, flat head machine screws for extending through said countersunk holes and threading into correspondingly threaded holes in said track ends, said flat heads having recesses configured to receive an Allen wrench end to rotate said machine screws.

9. A frame system which comprises:

at least two elongated tracks;

fastening means including transverse holes through said elongated tracks and screws for extending through said holes and into a support surface;

a pair of spaced longitudinal slots in each of said elongated tracks;

at least two elongated cover bars;

a pair of spaced longitudinal edges in each said elongated cover bar configured to slidingly fit in said longitudinal recesses for permitting said elongated cover bars to slide along said tracks while retaining said cover bars in contact with said tracks;

groove means along each of said elongated cover bars for retaining at least one panel edge therein;

cap means for covering longitudinal ends of said elongated cover bars;

a threaded hole in each longitudinal end of said elongated tracks;

a hole in each said cap means alignable with said threaded hole;

threaded means for extending through said cap hole and then into said threaded hole to prevent relative movement between said elongated tracks and said elongated cover bars.

10. The frame system according to claim 9 wherein said recesses are located adjacent to said surface when said cover bar is mounted on said surface so that said cover bars substantially entirely cover said tracks.

11. The frame system according to claim 9 wherein said grooves have widths sufficient to retain edges of at least two contiguous panels.

12. The frame system according to claim 9 wherein said threaded holes comprise a threaded insert having a threaded exterior threaded into a hole in said track and a threaded interior for receiving said threaded means.

13. The frame system according to claim 9 wherein each of said threaded means comprises a flat headed machine screw having a head recess configured to receive an Allen wrench end for rotating said screw.

14. A frame system which comprises:

at least two elongated tracks;

mounting means for mounting said elongated tracks on a support surface;

at least two elongated cover bars;

cooperating means on said tracks and cover bars for permitting said elongated cover bars to slide along said tracks while retaining said cover bars in contact with said tracks;

said cooperating means comprising longitudinal recesses along said tracks and corresponding longitudinal edges along said cover bars for sliding in said recesses;

said recesses being located adjacent to said surface when said cover bar is mounted on said surface so that said cover bars substantially entirely cover said tracks;

groove means along each of said elongated cover bars for retaining a panel edge therein;

cap means for covering ends of said elongated cover bars; and fastening means for releasably fastening said caps to said ends to prevent relative movement between said elongated tracks and said elongated cover bars;

said fastening means comprising threaded members extending through holes in said caps and threaded into threaded openings in said track ends.

15. The frame system according to claim 14 wherein said mounting means comprises at least two threaded fasteners for extending through transverse holes in said tracks and into threaded holes in said surface.

16. The frame system according to claim 15 wherein said grooves have widths sufficient to retain edges of at least two contiguous panels.

17. The frame system according to claim 15 wherein each said fastening means comprises a countersunk hole through said cap, flat head machine screws for extending through said countersunk holes and threading into correspondingly threaded holes in said track ends, said flat heads having recesses configured to receive an Allen wrench end to rotate said machine screws.

* * * * *